US005496190A

United States Patent [19]

Ittah et al.

[11] Patent Number: 5,496,190

[45] Date of Patent: Mar. 5, 1996

[54] ELECTRICAL CONNECTOR CASINGS

[75] Inventors: Jean Ittah, Villeneuve la Garenne; Thierry Badaroux, St Germain en Laye, both of France

[73] Assignee: Connecteurs Cinch, Montigny Le Bretonneux, France

[21] Appl. No.: 287,419

[22] Filed: Aug. 9, 1994

[30] Foreign Application Priority Data

Sep. 10, 1993 [FR] France ..... 93 10814

[51] Int. Cl.[6] ..... H01R 13/627

[52] U.S. Cl. ..... 439/354; 439/357

[58] Field of Search ..... 439/350, 351, 439/352, 353, 354, 357, 358, 488, 489

[56] References Cited

U.S. PATENT DOCUMENTS

| | | | |
|---|---|---|---|
| 4,984,998 | 1/1991 | Duncan et al. | 439/352 |
| 4,986,766 | 1/1991 | Leonard et al. | 439/353 |
| 5,254,014 | 10/1993 | Yagi et al. | 439/352 |
| 5,292,258 | 3/1994 | Sakurai | 439/353 |
| 5,292,259 | 3/1994 | Sheldrake et al. | 439/353 |
| 5,330,366 | 7/1994 | Tsuji et al. | 439/352 |

FOREIGN PATENT DOCUMENTS

| | | |
|---|---|---|
| 0356157 | 2/1990 | European Pat. Off. . |
| 58-41745 | 9/1983 | Japan . |
| 2243029 | 10/1991 | United Kingdom . |

*Primary Examiner*—Larry I. Schwartz
*Assistant Examiner*—Hien D. Vu
*Attorney, Agent, or Firm*—Sandler, Greenblum & Bernstein

[57] ABSTRACT

Electrical connector casings comprising a female casing member and a male casing member the male casing member, wherein includes an inclined elastic bar fastened at a point partway along its length to an abutment and the female casing member has a passage adapted to receive the elastic bar. Partway along the length of this passage is a projection on the path of the abutment and having, on the side facing the opening of the female casing member, a steep edge joining at right angles to a part joining at right angles a .retaining steep edge which, with the abutment, locks the two casing members together.

3 Claims, 3 Drawing Sheets

ELECTRICAL CONNECTOR CASINGS

BACKGROUND OF THE INVENTION

1. Field of the Invention

The present invention concerns improvements to electrical connector casings.

2. Description of the Prior Art

The invention is directed to connector casings formed by a female member adapted to receive a male member, one of the members containing male or female electrical connection members and the other corresponding members to be connected.

Various systems have been designed to ensure that the two casing members are perfectly coupled together so that the electrical connections are made.

One of these known systems uses the "swallower" technique whereby when the two casing members are partially inserted one within the other the male casing member is automatically drawn fully into the female casing member.

The present invention is directed to a system of this type which is reliable in operation, of acceptable unit cost and practical to use.

Japanese patent n° 5 841 745 describes an electrical connector provided with a system of this type.

In this Japanese patent the male casing member includes an elastic bar which tilts from the end adapted to be inserted into the female casing member and which includes, partway along its length, an abutment adapted to cooperate with a projection on said casing member.

This kind of implementation has drawbacks.

To be effective, when the abutment is retracted to insert the male casing member into the female casing member, it is necessary to overcome a hard spot after which the system operates automatically.

In the Japanese patent, when pressure is applied to the elastic bar the abutment is retracted and there is no indication of the insertion length from which the system operates.

To be sure that the male connection members are perfectly inserted in the female connection members said male connection members must have a certain length and it is therefore indispensable that insertion of the male casing member into the female casing member represents a relatively long travel. If the system is required to operate over virtually all of this travel, the reaction force of the elastic bar must be high and the surfaces in contact of the abutment and the projection must be as small as possible.

In the implementation described in the Japanese patent the travel is necessarily small and the reaction force of the elastic bar is low so that the dimensions of the casing are small.

One object of the present invention is to overcome these various drawbacks.

SUMMARY OF THE INVENTION

The invention consists in improvements to electrical connector casings of the type comprising a female casing member with an opening for inserting a male casing member, said two members being adapted to receive electrical connection members to be coupled together, said casing being provided with a "swallower" system enabling the male member to be fully inserted and locked automatically when the male casing member has been inserted to a particular position within the female casing member, said male casing member including an elastic bar extending laterally, parallel to the direction of insertion of the male member into the female member and being fastened at one end to the male casing member and at the other end to a pillar near the end of the male casing member adapted to be inserted in the female member, said elastic bar including partway along its length an abutment and said female casing member having a passage adapted to receive said elastic bar and partway along which is a projection disposed on the path of said abutment; by virtue of said improvements the elastic bar is inclined towards the end of the male casing member opposite that adapted to be inserted in the female casing member, said abutment having the shape of a substantially parallelepiped-shape block and said projection having, on the side facing towards the opening of said female casing member, a steep edge joining at right angles a part joining at right angles a retaining steep edge adapted with said abutment to lock the two casing members together.

By virtue of this arrangement, when pressure is applied to the male casing member to insert it in the female casing member the abutment bears against the steep edge of the projection which causes bending of the intermediate part of the elastic bar so that a certain insertion force enables the abutment to pass under the projection.

As soon as the abutment has passed just beyond the projection it bears against the corner joining the retaining steep edge to the part joining the two steep edges so that the elastic action of the bar causes the male casing member to be automatically drawn into the female casing member until the two casing members are locked together.

In accordance with one constructive feature of the invention, near its end adjacent the end of the male casing member opposite that adapted to be inserted in the opening of the female casing member, the elastic bar is fastened to a web whose free end is fastened to a transverse bar joined by two elastic lugs to the corresponding end of the male casing member.

This provides a simple means of uncoupling the two casing members. Also, the elastic action of the bar is reinforced by the elastic lugs.

The invention is next described in more detail with reference to a specific embodiment given by way of example only and shown in the appended drawings.

DETAILED DESCRIPTION OF THE PREFERRED EMBODIMENT

Figure 1:
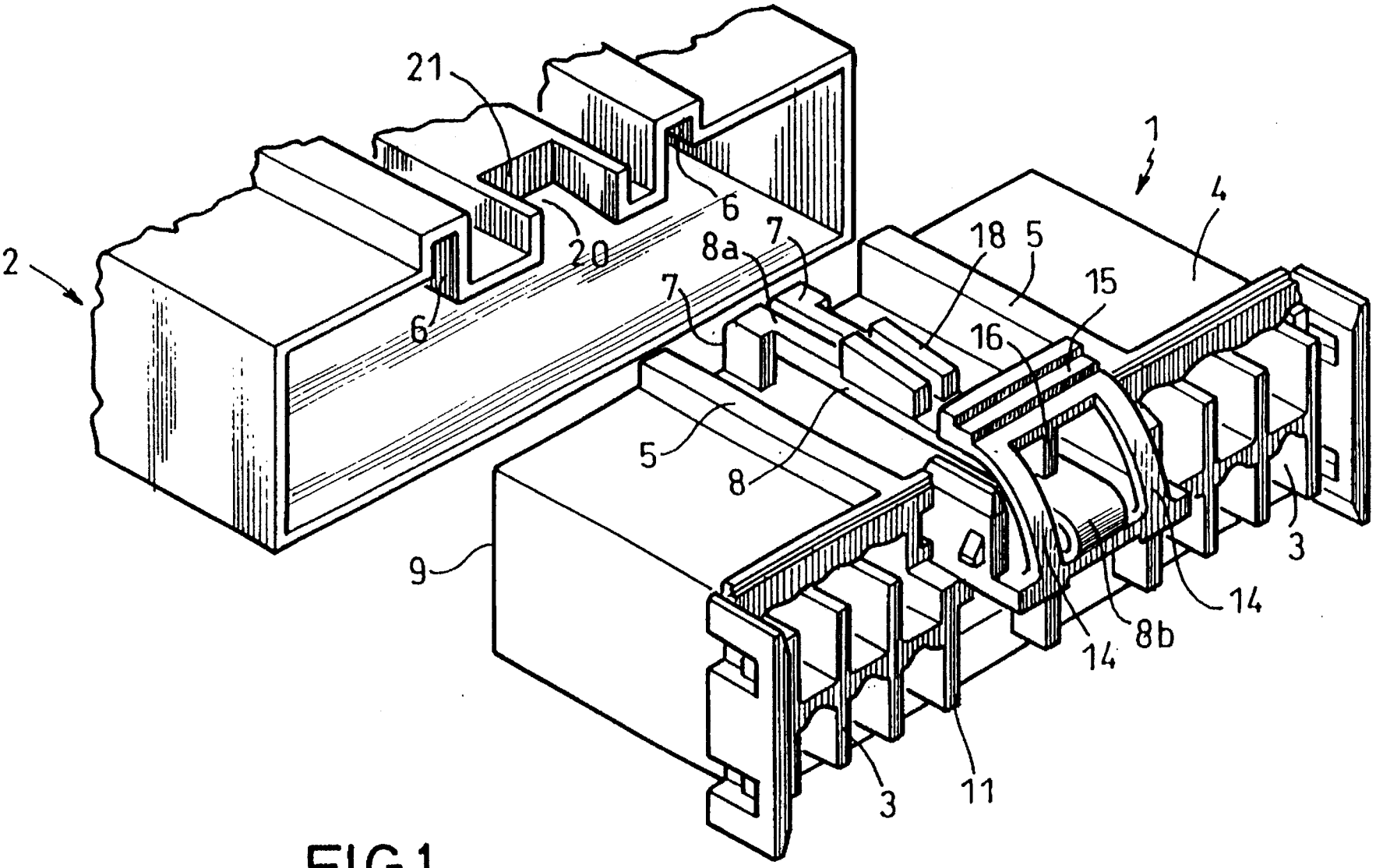
FIG. 1 is a diagrammatic perspective view of a connector of the invention.

The connector shown in the figures comprises a male casing member 1 and a female casing member 2 adapted to receive the casing member 1.

The male casing member 1 includes a series of passages 3 each adapted to receive a female electrical connection member connected to a conductor. These members are known and are not shown here.

The male casing member 1 has, on its lateral surface 4, two parallel ribs 5 adapted to cooperate with corresponding slideways 6 of the female casing member 2.

Near the end 9 adapted to be inserted into the female casing member 2 the male casing member 1 has on its surface 4 two pillars 7 supporting an elastic bar 8 whose free end is fastened to an end 11 of the male casing member 1 opposite the end 9.

The elastic bar 8 is inclined from its end 8*a* adjacent the end 9 towards its end 8*b* adjacent the end 11.

On respective sides of the end 8*b* of the bar 8 are two elastic lugs 14 joined at their free end by a bar 15 in turn joined by a web 16 to the elastic bar 8, this combination constituting an unlocking member.

Partway along its length, the bar 8 carries an abutment 18 in the form of a parallelepiped-shape block.

The female casing member has a passage 20 between the slideways 6 to receive the combination of the pillars 7 and the bar 8.

The passage 20 is partially closed by a projection on the path of the abutment 18 and which has at the end towards the opening for insertion of the male casing member a steep edge 21*a* merging at right angles with a part 21*b* in turn merging at right angles with a retaining steep edge 21*c*.

The rear end of the female casing member 2 is provided with male members 24 adapted to cooperate with the female members in the passages 3.

Operation is as follows:

The member 1 is inserted in the member 2, the ribs 5 cooperate with the slideway 6, and the pillars 7 and the end 8*a* are inserted in the passage 20 (see FIG. 2) until the abutment 18 bears against the steep edge 21*a*.

Figure 2:
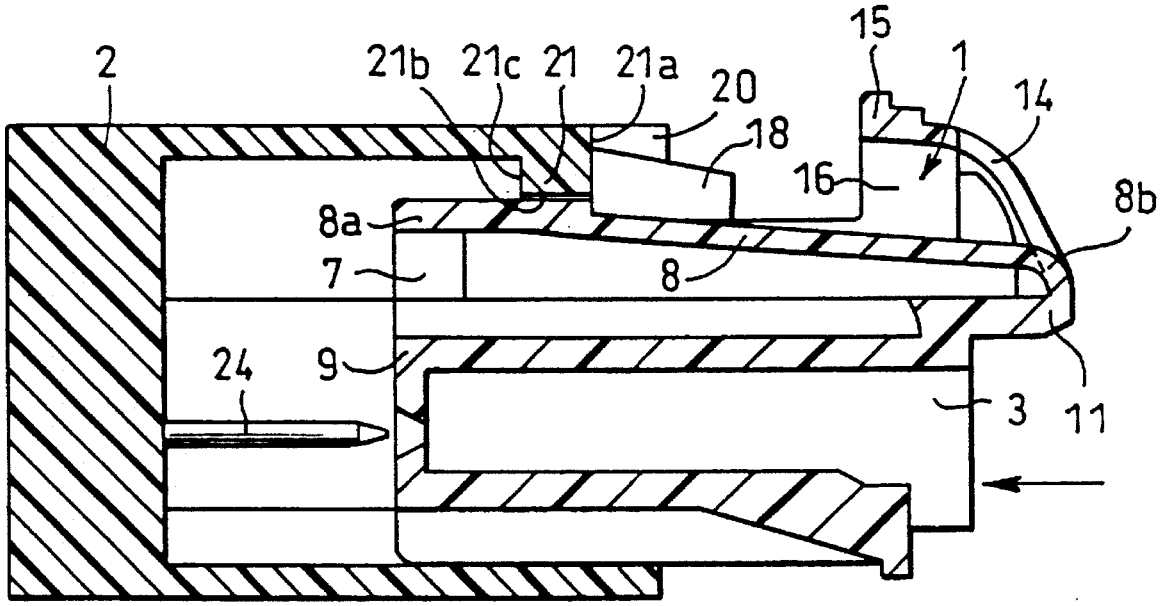
FIGS. 2, 3, 4 and 5 are views in section showing the operation of the connector of the invention.
Figure 3:
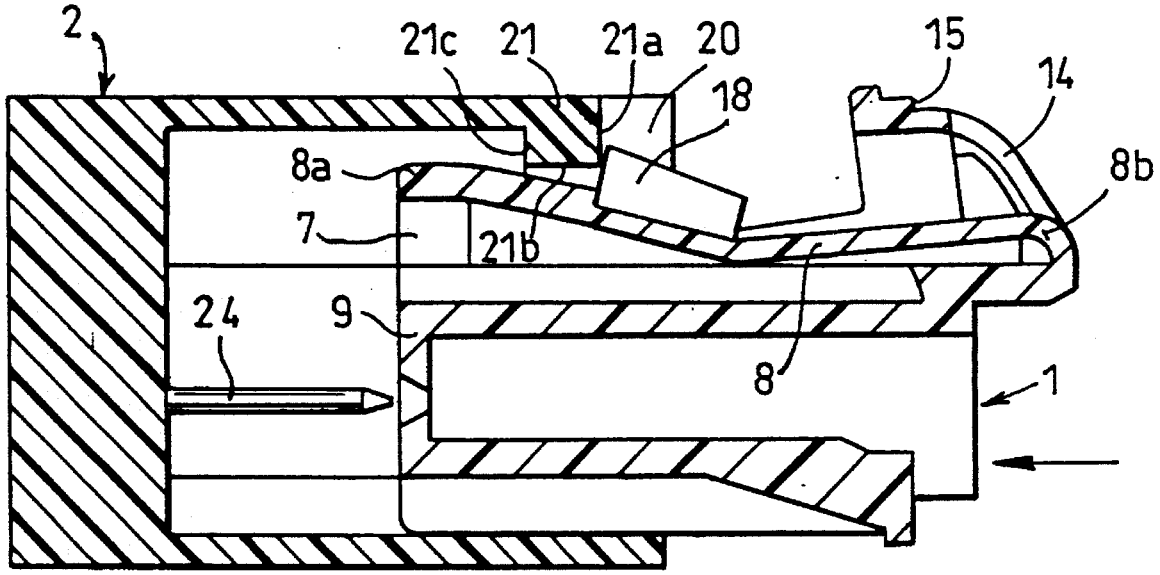
Figure 4:
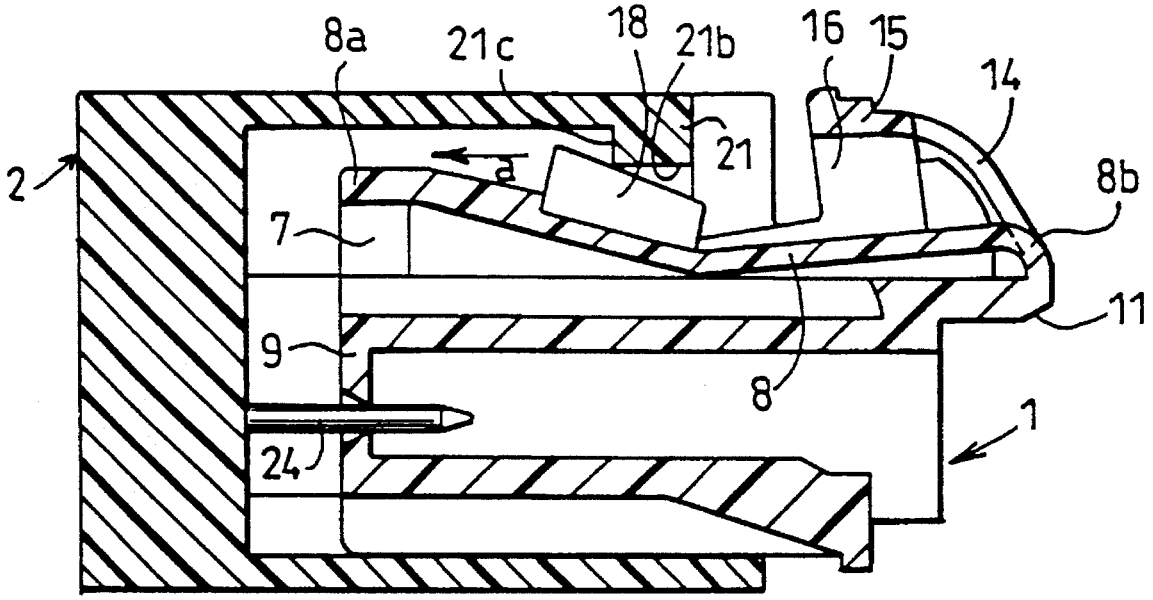

Upon further insertion of the member 1 into the member 2 the elastic bar 8 bends from its end 8*a* to its end 8*b* and so the end of the abutment 18 facing towards the pillars passes under the part 21*b* (see FIGS. 2 and 4). Given the reaction force of the bar 8, it is necessary to apply slight pressure until said end of the abutment has passed beyond the edge separating 21*b* and 21*c*. When this corner has been passed, the elastic action of the bar 8 tends to return it to its initial position and so the casing member 1 is automatically displaced (in the direction of the arrow a - see FIG. 4 - until it is drawn completely into the casing member 2, the abutment then cooperating with the retaining steep edge 21*c* to lock the casing members together (see FIG. 5).

Figure 5:
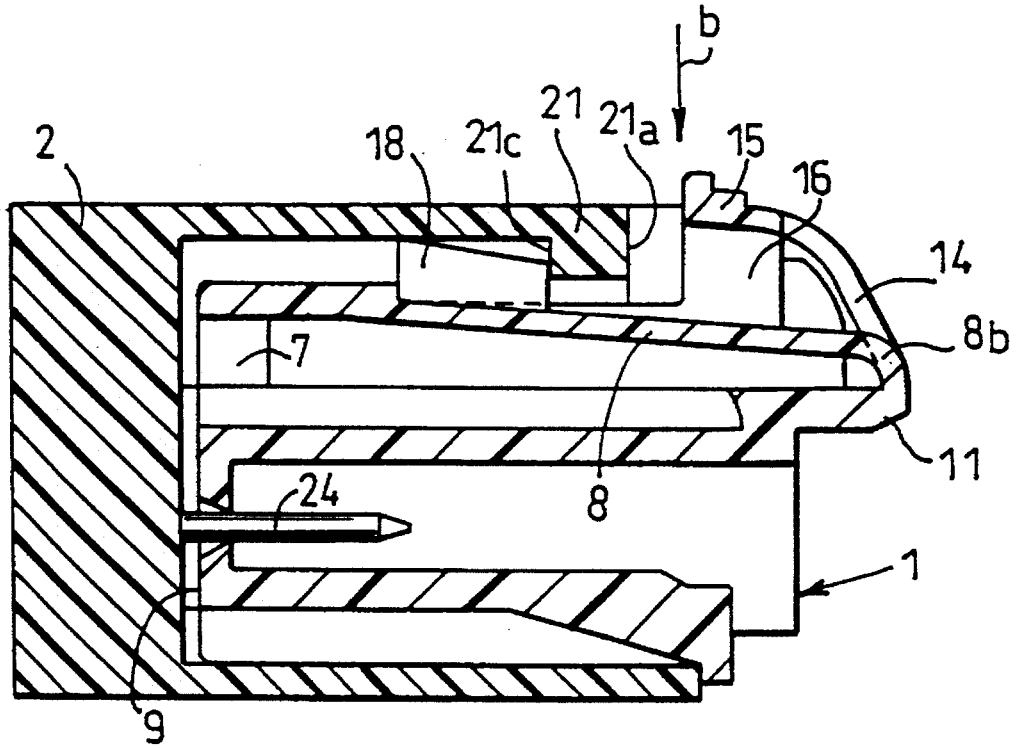

To uncouple the casing members 1 and 2 it suffices to exert pressure on the bar 15 in the direction of the arrow b in order to release the abutment 18 from the projection 21 and then to pull the member 1 in the direction opposite the direction of the arrow a (see FIG. 5).

The lengths of the electrical connection members are preferably such that they cooperate only when the abutment 18 is cooperating with the corner linking the steep edge 21*c* to the part 21*b* so that it is certain that the casing members will be assembled together.

Of course, the invention is not limited to the embodiment that has just been described and shown. Numerous modifications of detail can be made thereto without departing from the scope of the invention.

There is claimed:

1. Electrical connector casings, comprising:

a male casing member adapted to receive first electrical connection members;

a female casing member including an opening for insertion of said male casing member in an insertion direction, said female casing member adapted to receive second electrical connection members capable of coupling with said first electrical connection members;

said male casing member comprising:

a first end that is adapted to be inserted into an opening in said female casing member, and a second end opposite said first end;

pillars positioned near said first end of said male casing member; and an elastic bar extending laterally, substantially parallel to a direction of insertion of said male member into said female member, said elastic bar including two ends, with one of said two ends being fastened to said male casing member adjacent said second end of said male casing member, and the other of said two ends being fastened to said pillar, said elastic bar being inclined towards said second end, and an abutment is positioned partway along the length of said elastic bar, with said abutment comprising a substantially parallelpiped-shaped block;

said female casing comprising:

a passage adapted to receive said elastic bar, and a projection positioned partway along said passage along a path of travel of said elastic bar, said projection comprising a steep edge on a side facing towards said opening of said female casing member, said steep edge joining at right angles a part joining at right angles a retaining steep edge interacting with said abutment to lock said male casing member and said female casing member together, so that said male casing member is automatically inserted and locked when said male casing member is inserted to a particular position within said female casing member; and said male casing member including an unlocking member positioned near said one end of said elastic bar to enable release of said abutment from said projection for separation of said male casing member and said female casing member.

2. The electrical connector casing according to claim 1, wherein said unlocking member comprises a web fastened to said elastic bar near said one end, and said web comprises an end fastened to a transverse bar joined by an element to said second end of said male casing member.

3. The electrical connector casing according to claim 2, wherein said element comprises two elastic lugs.

* * * * *

UNITED STATES PATENT AND TRADEMARK OFFICE

CERTIFICATE OF CORRECTION

PATENT NO. : 5,496,190

DATED : March 5, 1996

INVENTOR(S) : J. ITTAH et al.

It is certified that error appears in the above-indentified patent and that said Letters Patent is hereby corrected as shown below:

On the cover, in section [57], "ABSTRACT", line 2, after "member" (first occurrence) insert ---, wherein---.

On the cover, in section [57], "ABSTRACT", line 10, change ".retaining" to ---retaining---.

At column 3, line 18, after "projection" insert ---21---.

At column 4, line 22 (claim 1, line 21), change "pillar," to ---pillars,---.

Signed and Sealed this

Thirteenth Day of August, 1996

Bruce Lehman

*Attest:*

BRUCE LEHMAN

*Attesting Officer*

*Commissioner of Patents and Trademarks*